United States Patent [19]

Mori et al.

[11] Patent Number: 4,564,395

[45] Date of Patent: Jan. 14, 1986

[54] METHOD FOR PRODUCING AMORPHOUS METALS

[75] Inventors: Hirotaro Mori, Suita; Hiroshi Fujita, Ibaraki, both of Japan

[73] Assignee: Osaka University, Suita, Japan

[21] Appl. No.: 585,912

[22] Filed: Mar. 2, 1984

[30] Foreign Application Priority Data

Jul. 16, 1983 [JP] Japan ..... 58-128709

[51] Int. Cl.[4] ..... C22F 3/00

[52] U.S. Cl. ..... 148/4; 148/403

[58] Field of Search ..... 148/403, 3, 4, 1, 13; 219/121 EB, 121 EF, 121 EG; 156/DIG. 102

[56] References Cited

U.S. PATENT DOCUMENTS 3,926,682 12/1975 Shimada et al. ..... 148/4

4,122,240 10/1978 Banas et al. ..... 219/121 EG

OTHER PUBLICATIONS

"Properties and Applications of Ion Implanted Alloys," Myers, Journal of Vacuum Science and Technology, vol. 17, No. 1, Jan.-Feb. 80.

*Primary Examiner*—L. Dewayne Rutledge
*Assistant Examiner*—S. Kastler
*Attorney, Agent, or Firm*—Spencer & Frank

[57] ABSTRACT

An amorphous metal having a desired irregularity is formed by irradiating a metal with an electron beam having an energy large enough to damage the metal thereby introducing a lattice defect into the metal and controlling the concentration of the introduced lattice defect.

1 Claim, 1 Drawing Figure

METHOD FOR PRODUCING AMORPHOUS METALS

BACKGROUND OF THE INVENTION

1. Field of the Invention

The present invention relates to a novel method for producing amorphous metals.

2. Description of the Prior Art

Amorphous metals have recently attracted interest as novel materials rich in functional properties in a broad industrial field because of their excellent physical and chemical properties.

Methods for producing these amorphous metals, rapid cooling (quenching) of a molten metal and vapor deposition have been proposed, but the former has been mainly carried out. In this method, a given metal is heated once, melted and the molten metal sprayed onto a rapidly rotating copper plate or the like through a nozzle to quench the molten metal, whereby the given amorphous metal is obtained. In this method, it is essential to obtain a high quenching rate, so that the form of the product is limited to a ribbon shape or a linear shape and it is impossible to obtain a thick product and further it is impossible to make only a surface thereof amorphous. Furthermore, it is difficult to control the quenching rate and therefore, it is impossible to control the amorphous rate (irregularity) of the product. These drawbacks inevitably occur, and the commercially applicable range of the resulting product is narrow and limited. In the latter method, a given metal is vaporized once, condensed and grown on a base plate to obtain an amorphous metal. In this method, only a thinner product than that obtained with the former method is produced and further the cost becomes very high.

SUMMARY OF THE INVENTION

The present invention is intended to overcome these drawbacks in the prior methods.

An object of the present invention is to produce cheaply amorphous metals having the desired shape and size.

A further object of the present invention is to rapidly transform a metal into an amorphous metal having a desirably designed irregularity.

The present invention lies in a method for producing an amorphous metal characterized in that a given metal is irradiated with an electron beam having an energy large enough to damage said metal and thereby introduce a lattice defect into the metal. The concentration of the introduced lattice defect is controlled to obtain an amorphous phase of the desired irregularity.

The term "damage" used herein means that the arrangement of atoms forming the crystal is disturbed.

The method of the present invention can produce a pipe-, rod-, plate-formed or a complicated formed amorphous metal or an amorphous coated metal.

The term "amorphous metal" used herein means not only an amorphous metal but also an amorphous coated metal.

The amorphous metals produced by the method of the present invention can be used for a shape memory alloy and in this case, the shape memory alloy can be safely used by a memory erasing method.

DESCRIPTION OF THE PREFERRED EMBODIMENTS

Figure 1:
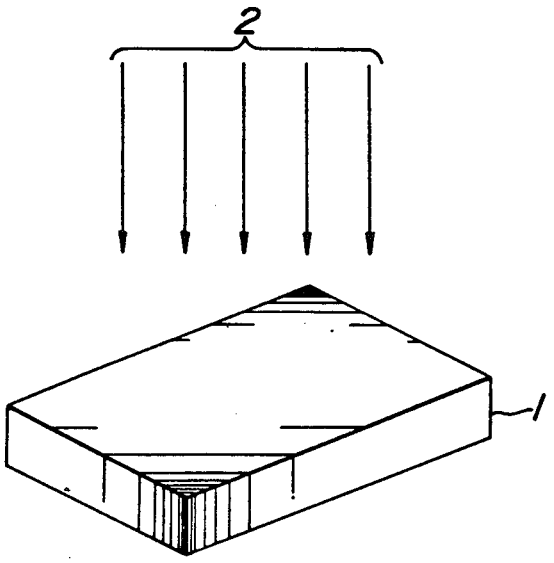
FIG. 1 is a schematic perspective view showing a step for irradiating a metal with an electron beam according to the present invention.

In FIG. 1, a metal 1 shaped in a given form is irradiated with a high speed electron beam 2 having an energy large enough to damage said metal under the following condition. The irradiation is performed by keeping the electron beam flux at a flux density not exceeding $1.3\times10^{24}$ e/m$^2$·sec determined by the said metal, and by controlling the irradiating temperature at a temperature not exceeding 290° K. determined by the said metal and the above described flux density of electron beam flux. By the irradiation under such a condition, the lattice defect introduced into the metal owing to the damage caused by the irradiation is gradually accumulated in the metal and the concentration is increased with the irradiating time but when this concentration reaches a given value determined by the said metal, the irradiated metal is transformed into an amorphous metal.

In the method of the present invention, the introduction of the lattice defect is performed by using an electron beam having far higher penetrability than the other particle rays, so that when the given metal is a plate or a wire having a thickness of less than several μm, all of the said metal is formed into an amorphous metal. When the given metal has a greater thickness than the above described value, the surface layer region having a thickness of several μm in the base metal, which is irradiated with the electron beam, is made amorphous. Embodiments of the irradiating condition necessary for the formation of the amorphous metal are shown in the following Table 1.

TABLE 1

| Metal | Electron energy | Electron beam flux | Irradiating temperature | Irradiating time |
|---|---|---|---|---|
| NiTi | 2 MeV | $8.0\times10^{23}$ e/m$^2$ · sec | 250K | 150 sec |
| $Fe_2Ti$ | 2 MeV | $1.3\times10^{24}$ e/m$^2$ · sec | 290K | 100 sec |
| $Zr_2Al$ | 2 MeV | $1.3\times10^{24}$ e/m$^2$ · sec | 160K | 300 sec |
| CuZr | 2 MeV | $1.3\times10^{24}$ e/m$^2$ · sec | 250K | 60 sec |
| $Cu_3Ti_2$ | 2 MeV | $1.0\times10^{24}$ e/m$^2$ · sec | 230K | 120 sec |
| $Co_2Ti$ | 2 MeV | $1.1\times10^{24}$ e/m$^2$ · sec | 160K | 180 sec |
| $Cu_{10}Zr_7$ | 2 MeV | $1.2\times10^{24}$ e/m$^2$ · sec | 160K | 60 sec |
| $Zr_2Ni$ | 2 MeV | $1.0\times10^{24}$ e/m$^2$ · sec | 170K | 120 sec |
| $Nb_7Ni_6$ | 2 MeV | $9.5\times10^{23}$ e/m$^2$ · sec | 160K | 120 sec |
| MoNi | 2 MeV | $1.2\times10^{24}$ e/m$^2$ · sec | 160K | 1,020 sec |
| $Mn_2Ti$ | 2 MeV | $1.2\times10^{24}$ e/m$^2$ · sec | 170K | 300 sec |
| CuTi | 2 MeV | $1.2\times10^{24}$ e/m$^2$ · sec | 160K | 60 sec |

Other metals preferred for formation of amorphous metals include $V_3Si$ and iron-zirconium compound.

The merits of the method of the present invention are listed as follows.

(1) No quenching step as in the prior art is needed, so that even if a given article is a large size, the lattice defect is introduced through the irradiation of an electron beam and the region where the lattice defect is accumulated can be formed into an amorphous metal. Therefore, it is possible to coat the inner and outer walls of metal pipes having various diameters with an amorphous metal having excellent mechanical strength and corrosion resistance.

(2) A quenching step, which is difficult to control, is not performed and therefore the formed amorphous metal is even and the amorphous rate (irregularity) can be continuously controlled by varying the irradiated dosage.

(3) By utilizing the property that the electron beam can be easily curved by an electric magnetic field, the shape of the irradiated region, that is the region capable of being transformed into amorphous metal may be optionally controlled. Namely, an amorphous region having a desired size and shape extending from a desired large area to a very small region having a diameter of 1 μm or less, may be formed in a given base metal in a state where the connection to the base metal is good.

The method of the present invention has a large number of advantages as described above and is commercially very useful.

What is claimed is:

1. A method for converting at least the surface of an intermetallic compound selected from the group consisting of NiTi, $Fe_2Ti$, $Zr_2Al$, CuZr, $Cu_3Ti_2$, $Co_2Ti$, $CU_{10}Zr_7$, $Zr_2Ni$, $Nb_7Ni_6$, NoNi, $Mn_2Ti$, CuTi, $V_3Si$ and iron-zirconium into an amorphous metal comprising the steps of:

(a) irradiating said intermetallic compound with an electron beam having a flux density not exceeding approximately $1.3\times10^{24}$ e/m$^2$·sec, the energy of said electron beam being sufficient to introduce a lattice defect into said intermetallic compound;

(b) heating said intermetallic compound to a temperature not exceeding approximately 290° K.; and (c) maintaining said electron beam irradiation for at least approximately 60 seconds until at least the surface of said intermetallic compound has been converted into an amorphous metal.

* * * * *